US011064747B2

(12) United States Patent
Zahradka et al.

(10) Patent No.: US 11,064,747 B2
(45) Date of Patent: Jul. 20, 2021

(54) OUTERWEAR ARTICLE WITH CONVERTIBLE HAND COVERING

(71) Applicant: TARGET BRANDS, INC., Minneapolis, MN (US)

(72) Inventors: Sarah Jane Zahradka, North St. Paul, MN (US); Choua Yang, Maplewood, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 188 days.

(21) Appl. No.: 16/401,831

(22) Filed: May 2, 2019

(65) Prior Publication Data

US 2020/0345090 A1 Nov. 5, 2020

(51) Int. Cl.

| | |
|---|---|
| ***A41D 19/00*** | (2006.01) |
| ***A41D 19/01*** | (2006.01) |
| ***A41D 27/10*** | (2006.01) |
| ***A41D 3/00*** | (2006.01) |

(52) U.S. Cl.

CPC ..... *A41D 19/0041* (2013.01); *A41D 19/01* (2013.01); *A41D 27/10* (2013.01); *A41D 3/00* (2013.01)

(58) Field of Classification Search

CPC .... A41D 19/0041; A41D 19/01; A41D 27/10; A41D 3/00; A41D 15/002; A41D 19/0048; A41D 27/20; A41D 19/0017; A41D 3/02; A41D 11/00; A41D 15/00; A41D 2400/422; A41D 1/02; A41D 13/0012; A41D 13/081; A41D 19/002; A41D 19/0044; A41D 27/204; A41B 7/00; A41B 7/06; A41B 7/04

USPC ..... 2/269, 270

See application file for complete search history.

(56) References Cited

U.S. PATENT DOCUMENTS

| | | | | |
|---|---|---|---|---|
| 1,092,047 A * | 3/1914 | Hertz | A41D 19/0041 2/270 |
| 1,361,565 A | 12/1920 | Christy | |
| 2,136,879 A | 11/1938 | Haber et al. | |
| 2,226,066 A | 12/1940 | Moe | |
| 2,274,510 A | 2/1942 | Wohl et al. | |
| 2,283,561 A * | 5/1942 | Lindfelt | A41D 19/01 2/158 |
| 2,421,848 A * | 6/1947 | Philipps | A41D 19/0041 2/270 |

(Continued)

FOREIGN PATENT DOCUMENTS

| | | | |
|---|---|---|---|
| FR | 2232280 A1 * | 1/1975 | A41D 27/10 |
| FR | 2529760 A1 * | 1/1984 | A41D 19/0041 |
| GB | 432671 A * | 7/1935 | A41D 19/0041 |

*Primary Examiner* — Amy Vanatta

(74) *Attorney, Agent, or Firm* — JoAnn M. Seaton; Griffiths & Seaton PLLC

(57) ABSTRACT

An outerwear article comprises a sleeve and a hand covering. The sleeve defines and extends from a shoulder end and an open end. The sleeve includes a liner, an outer shell extending around the liner, and a pocket defined between the outer shell and the liner. The pocket has an opening on an inside of the sleeve and on a side of the pocket nearest the open end. The hand covering is sewn to the sleeve adjacent the opening via a seam line. The hand covering is rotatable about the seam line from a storage position within the pocket to a use position extending from the seam line out the open end of the sleeve to fit over a wearer's hand.

20 Claims, 15 Drawing Sheets

(56) References Cited

U.S. PATENT DOCUMENTS

| | | | | | |
|---|---|---|---|---|---|
| 2,603,790 | A | | 7/1952 | Boehm-Myro | |
| 3,214,771 | A | | 11/1965 | Treiber | |
| 4,297,746 | A | * | 11/1981 | Zarbos | A41D 3/00 2/108 |
| 4,773,100 | A | * | 9/1988 | Kuo | A41D 3/06 2/159 |
| 4,918,756 | A | | 4/1990 | Grilliot et al. | |
| 4,944,042 | A | | 7/1990 | DeWan | |
| 5,187,814 | A | | 2/1993 | Gold | |
| 5,361,415 | A | | 11/1994 | Deering et al. | |
| 5,749,098 | A | | 5/1998 | Evans | |
| 5,950,240 | A | | 9/1999 | Carpenter et al. | |
| 7,191,472 | B1 | | 3/2007 | Kishino | |
| 7,721,353 | B2 | | 5/2010 | Saturnio | |
| 8,245,321 | B2 | | 8/2012 | Ambrosio et al. | |
| 8,256,026 | B2 | | 9/2012 | Garrigos | |
| 8,904,564 | B2 | | 12/2014 | Laycock et al. | |
| 2003/0154536 | A1 | * | 8/2003 | Anderson | A41D 3/02 2/108 |
| 2012/0060256 | A1 | | 3/2012 | Parker | |
| 2012/0227153 | A1 | * | 9/2012 | Laycock | A41D 27/10 2/88 |
| 2018/0310648 | A1 | * | 11/2018 | Rhodes | A41D 27/10 |

* cited by examiner

OUTERWEAR ARTICLE WITH CONVERTIBLE HAND COVERING

BACKGROUND OF THE INVENTION

Typical outerwear coats and jackets are formed to protect the torso, arms, and, in some instances, the head of a wearer from weather elements such as cold, wind, rain, snow, etc. Outerwear oftentimes includes pockets, which can be used to protect a wearer's hands when they are placed into the pockets. However, mobility of the wearer is limited when her hands are placed in pockets and if a wearer wishes to further protect their hands, the wearer generally must employ a separate hand covering such as a glove or mitten. In addition, hand coverings can easily be misplaced or forgotten leaving the wearer with cold or wet hands when no such hand coverings are available. Such issues are exasperated in the case of children who often forget their gloves or mittens.

SUMMARY

An outerwear article comprises a sleeve and a hand covering. The sleeve defines and extends from a shoulder end and an open end. The sleeve includes a liner, an outer shell extending around the liner, and a pocket defined between the outer shell and the liner. The pocket has an opening on an inside of the sleeve and on a side of the pocket nearest the open end. The hand covering is sewn to the sleeve adjacent the opening via a seam line. The hand covering is rotatable about the seam line from a storage position within the pocket to a use position extending form the seam line out the open end of the sleeve to fit over a wearer's hand. Other outerwear articles, garment sleeves, assemblies, and methods of assembly are also contemplated.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

This innovation provides an outwear article with a hand covering attached thereto where the hand covering is selectively stored in a hidden interior pocket incorporated in a sleeve. The interior pocket is formed between an inner liner of the outerwear article and the outside shell of the outerwear article such that the inclusion of the interior pocket and the hand covering is generally hidden from view when the outerwear article is worn. More particularly, in one example, the pocket is positioned between two layer so liner interposed between the primary liner and the outer shell. In one embodiment, the interior pocket opens along a boundary between the liner and a cuff of the sleeve. The hand covering is stitched or otherwise coupled to the sleeve on one side thereof and open on the opposing side of the sleeve. In this manner, when the hand covering is pulled out of the interior pocket to extend from the bottom of the sleeve, the hand covering remains coupled to the sleeve, but open on one side to allow the wearer to move his/her hand into the hand covering.

In one embodiment, the hand covering and the sleeve include mating fastening mechanisms for selectively securing the free side of the hand covering to the sleeve when desired. In this manner, the hand covering is hidden from view during times of storage, and extends to receive a wearer's hand during times of use. Since the hand covering is secured to the sleeve, the wear will never find themselves without a hand covering when they are wearing the outerwear article.

Figure 1:
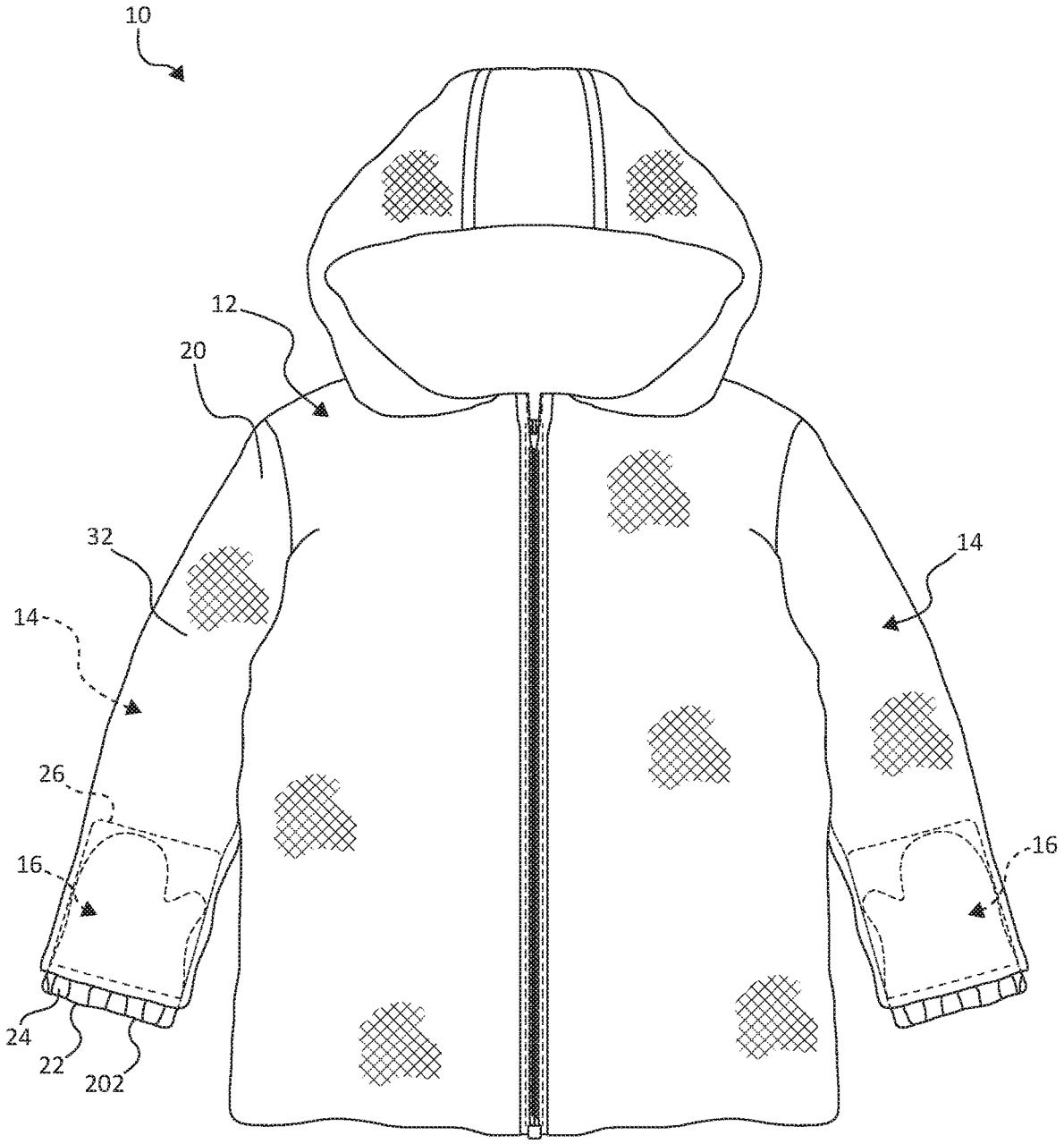
FIG. 1 is a front view illustration of an outerwear article with hand coverings in a storage position, according to one embodiment of the present invention.
Figure 2:
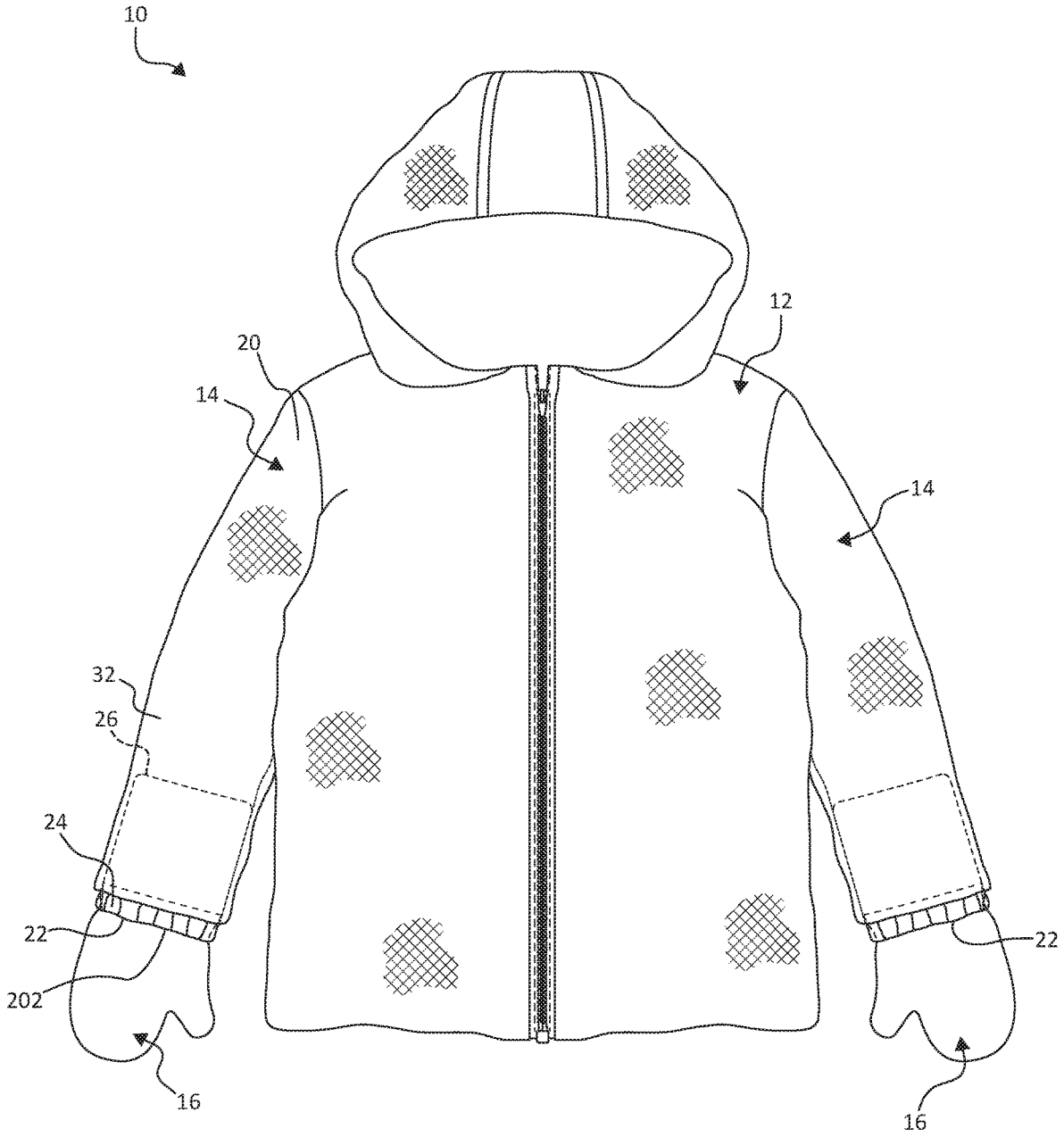
FIG. 2 is a front view illustration of the outerwear article with hand coverings in an extended, use position, according to one embodiment of the present invention.

Turning to the Figures, FIGS. 1 and 2 illustrate a front view of an outerwear article according to the present invention. For clarity of description, throughout this application the outerwear article will be referred to as coat 10, but it should be understood that other outerwear articles such as jackets, pull overs, sweatshirts, etc. are also contemplated as outerwear that could incorporate the present invention. Coat 10 includes a torso covering portion 12, two sleeves 14 extending from opposite sides thereof and being configured to receive the arms of a wearer (not shown) when the torso covering portion 12 is positioned on the body of the wearer, and two hand coverings 16.

More specifically, each sleeve 14 extends from a shoulder end 20 adjacent torso covering portion 12 to a bottom opening 22 with an arm-receiving channel extending therethrough and a cuff 24 extending around bottom opening 22. In one embodiment, an interior pocket 26 is formed in each of sleeves 14 and extends upwardly from cuff 24 into sleeve 14. Each interior pocket 26 is sized and shaped to selectively receive a corresponding one of the two hand coverings 16 in a manner substantially hidden from external view of coat 10 when coat 10 is worn by a wearer.

Figure 3:
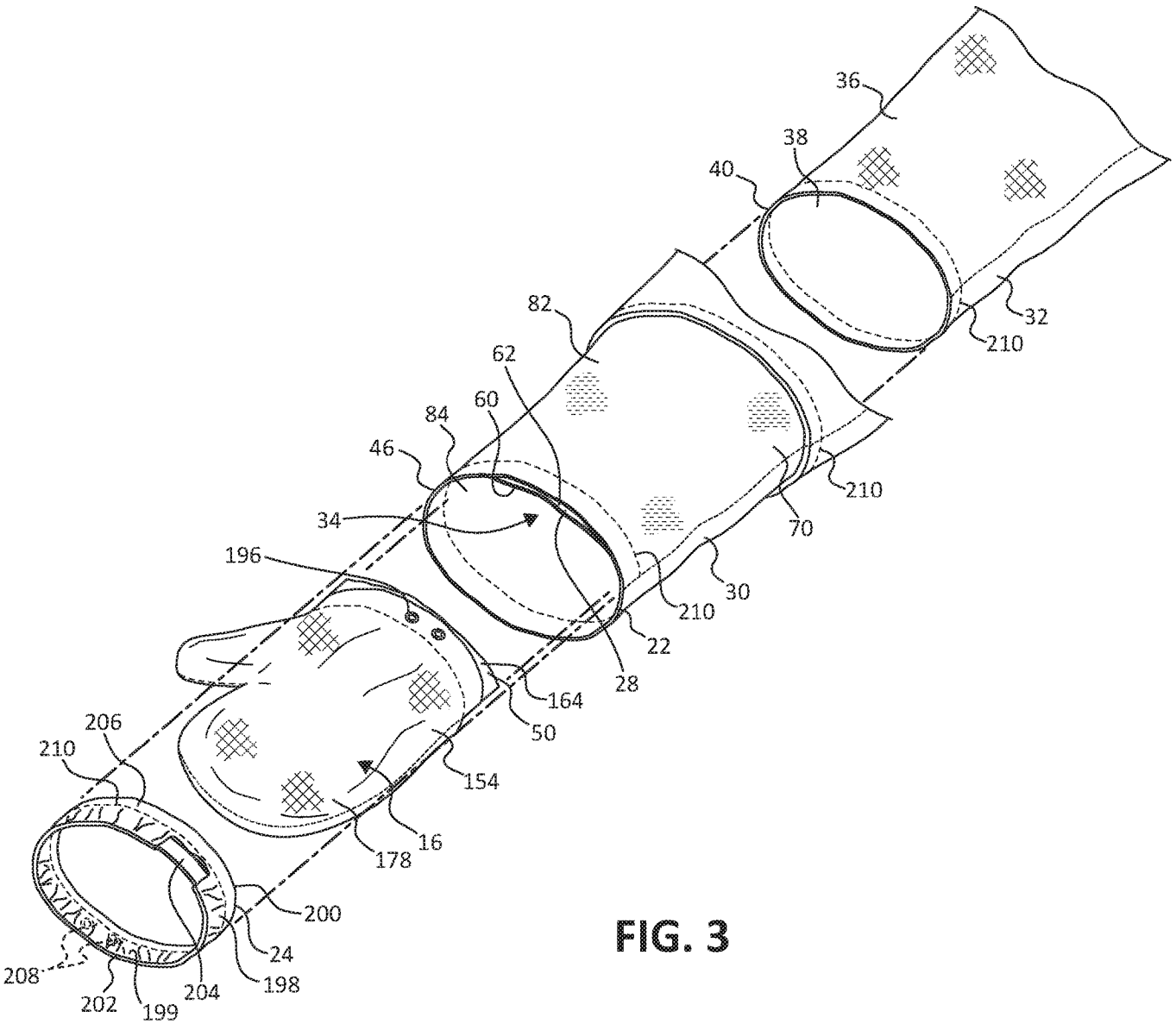
FIG. 3 is a perspective view illustration of a portion of an inside-out sleeve of the outerwear article, according to one embodiment of the present invention.
Figure 4:
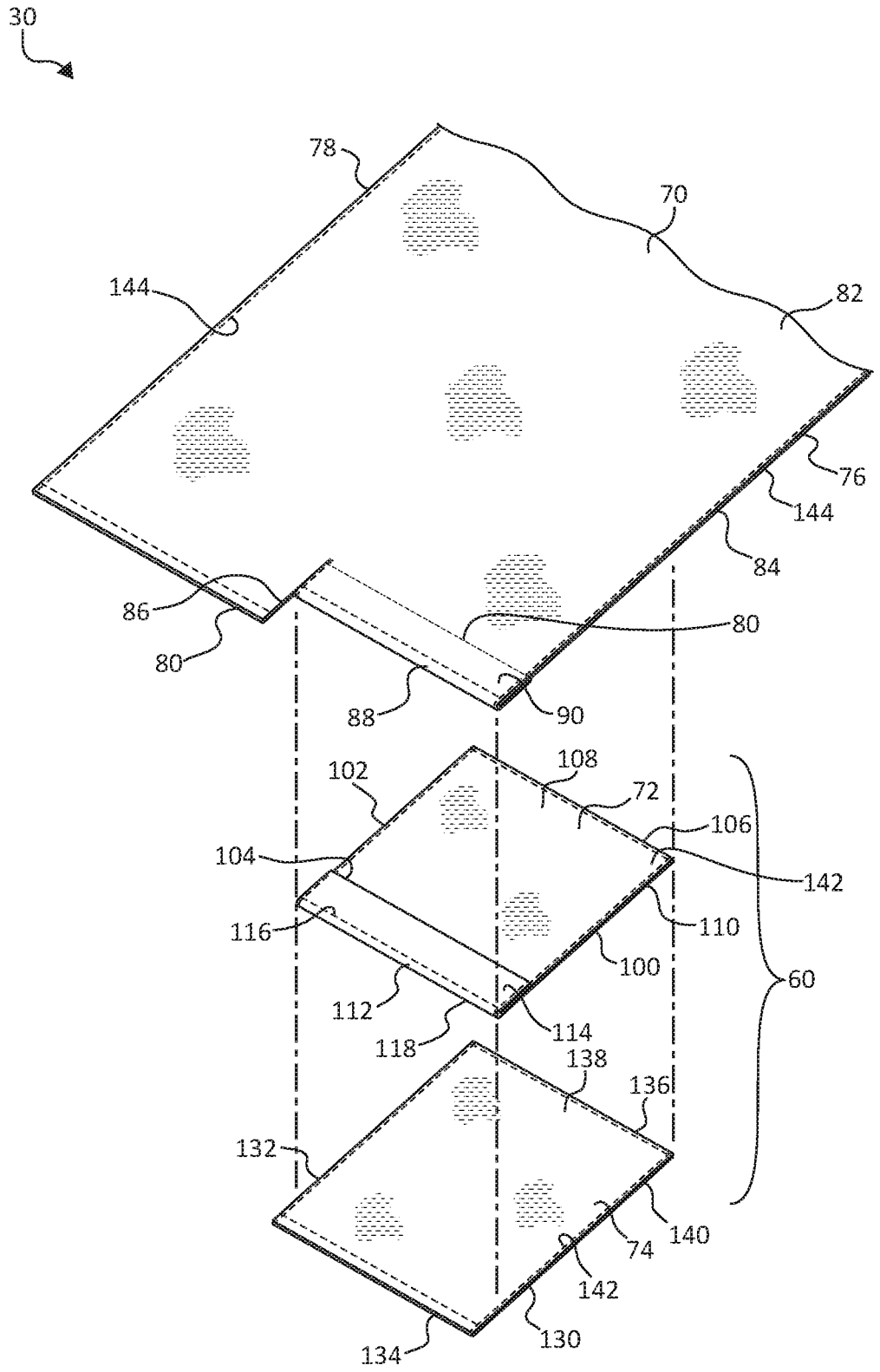
FIG. 4 is an exploded perspective view illustration of a sleeve liner and interior pocket panels, according to one embodiment of the present invention.

Sleeve 14 is formed of at least two layers including an interior liner 30 (see, e.g., FIG. 3) and an outer shell 32 generally surrounding interior liner 30, each of interior liner 30 and outer shell 32 are sewn to itself to define a substantially tubular form. Interior liner 30 defines an interior channel 34 formed therethrough. Interior liner 30 is formed of a fabric and serves to provide a neat inside finish to coat 10 concealing stitching on an inside of the outer shell 32. In one example, interior liner 30 is formed of a relatively thin material having a substantially smooth, allowing coat 10 to be more easily pulled on and off a wearer, thereby, extending the useful life of coat 10. Interior liner 30 may additionally add to the warmth of coat 10, but in some instances does not. In one embodiment, interior liner 30 is made of a suitable fabric such as a tricot or fleece material. Outer shell 32 is formed of any suitable fabric that, in one embodiment, is designed to withstand cold, wind, and/or precipitation elements. In one embodiment, outer shell 32 is formed of a fabric such as, taffeta, or other suitable fabric. As illustrated in the drawing, interior liner 30 and the outer shell 32 are generally shown with different hatched shading to more readily illustrate which is shown as some figures are shown with sleeve 14 inside-out and others are shown with sleeve 14 right-side-out.

Outer shell 32 is formed from a planar fabric and defines an exterior surface 36, e.g., a right side, and an interior surface 38, e.g., a wrong side, thereof. Opposing edges of outer shell 32 are sewn to one another either before or after positioning outer shell 32 about interior liner 30, forming outer shell 32 in a generally tubular manner, for example a frustoconical tube, extending from shoulder end 20 adjacent torso covering portion 12 (FIGS. 1 and 2) to a free or open end 40.

Interior liner 30 is also assembled to be in a generally tubular, such as a frustoconically tubular shape, to fit within and to conceal interior surface 38 of outer shell 32. In one embodiment, interior liner 30 is formed to define interior pocket 26 with a pocket opening 62. For example, interior liner 30 includes a primary liner member 70 and a pocket panel 60, for instance, a pocket panel 60 formed of an interior pocket panel member 72 and an exterior pocket panel member 74. Primary liner member 70 forms the primary portion of interior liner 30 defining interior channel 34. Pocket panel 60 is sewn thereto to define interior pocket 26.

In one embodiment, primary liner member 70 is formed of substantially planar, but flexible material and generally defines a first side edge 76, a second side edge 78, and an opening edge 46. An interior-facing surface 82 is defined between first side edge 76, second side edge 78, and opening edge 40, and an exterior-facing surface 84, that is, an outer shell facing surface, is similarly formed facing in an opposite direction as interior-facing surface 82. In one example, primary liner member 70 includes a cut 86 extending from opening edge 80 inward into the interior of primary liner member 70. A fold-over portion 90 on one side of cut 86 is folded toward exterior-facing surface 84 to form a folded edge 88, for example, adjacent first side edge 76.

Interior pocket panel member 72 and exterior pocket panel member 74 are, in one example, formed of the same material as primary liner member 70. In one embodiment, interior pocket panel 72 and exterior pocket panel 74 are similarly sized and shaped to one another and are both formed of a similar substantially planar, but flexible, material. For example, interior pocket panel member 72 defines a first side edge 100, a second side edge 102, an opening edge 104, and a closed edge 106. Interior pocket panel member 72 is substantially planar and further defines an exterior facing surface 108 and an interior facing surface 110. Interior pocket panel member 72 is folded near opening edge 104 back upon itself so a portion of exterior facing surface 108 is adjacent a remainder of exterior facing surface 108 to define a folded edge 112.

During assembly, as will be apparent to one of skill in the art upon reading this application, primary liner member 70 is sewn to interior pocket panel member 72 adjacent each of folded edge 88 and folded edge 112, for instance along each of folded edges 88 and 112, to form a clean edge along pocket opening 62 inset from opening edge 46 of primary liner member 70 on the opposing side of cut 86, as will be understood by those of skill in the art upon reading this application. In one embodiment, pocket opening 62 is formed as a welt opening.

Exterior pocket panel member 74 is sized shaped and formed of a similar material as interior pocket panel member 72, in one embodiment, as described above. As such, in one example, exterior pocket panel 74 defines a first side edge 130, a second side edge 132, an opening edge 134, and a closed edge 136. Exterior pocket panel 74 is substantially planar and further defines an exterior facing surface 138 and an interior facing surface 140. During assembly, first side edge 130, second side edge 132, and closed edge 136 of exterior pocket panel member 74 are generally aligned with and sewn to first side edge 100, second side edge 102, and closed edge 106 of interior pocket panel member 72 via a perimeter pocket seam 142. In this manner, interior pocket 26 is formed between exterior pocket panel member 74 and interior pocket panel member 72 and is substantially covered on an interior side thereof by primary liner member 70. In one example, opening edge 80 of primary liner member 70 and opening edge 134 of exterior pocket panel 74 are positioned to be substantially co-linear with each other.

Figure 10:
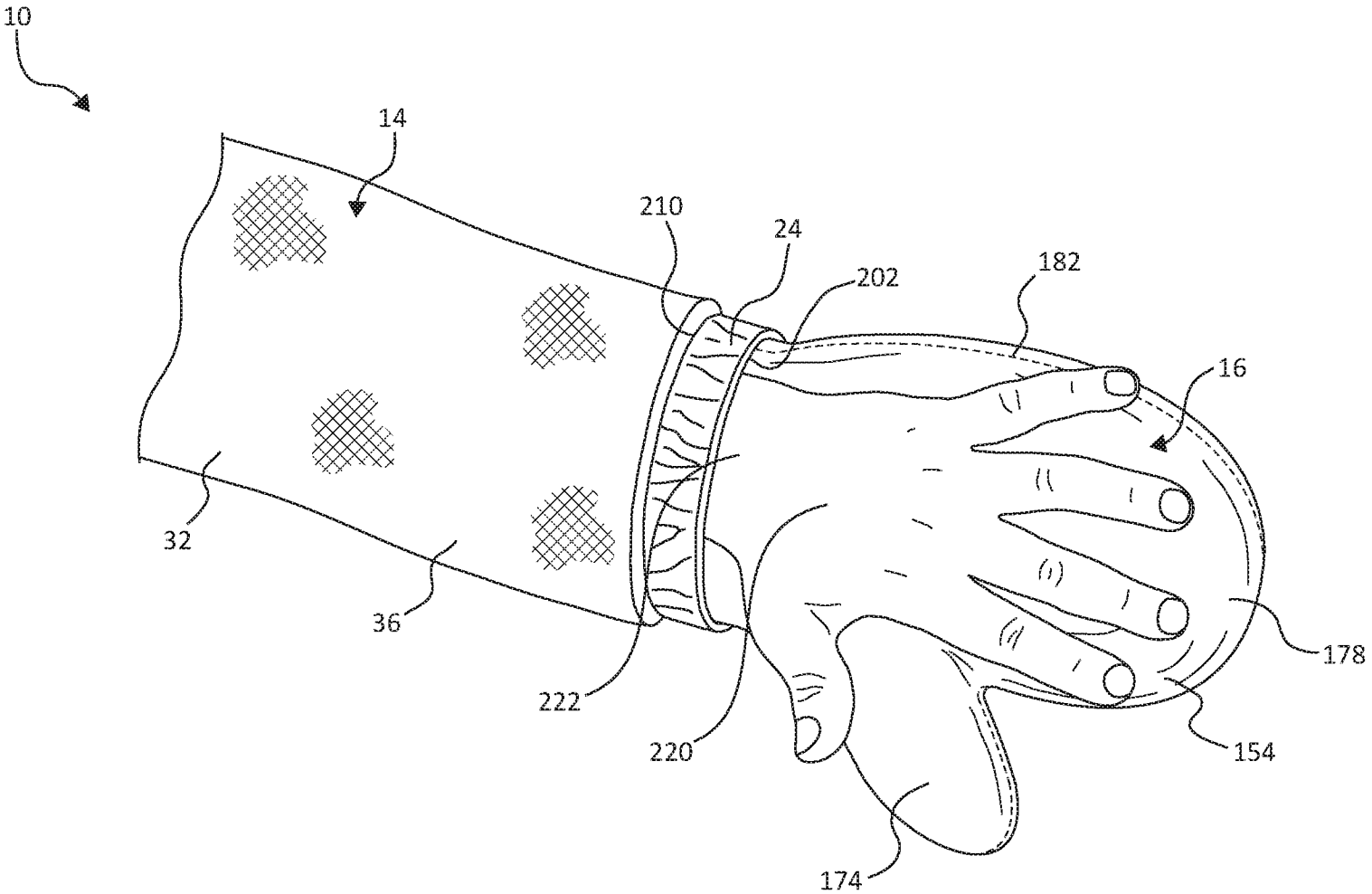
FIG. 10 is rear, perspective view of a portion of the sleeve turned right-side-out with the hand covering in the use position and a wearer's hand extending through the sleeve, according to one embodiment of the present invention.
Figure 11:
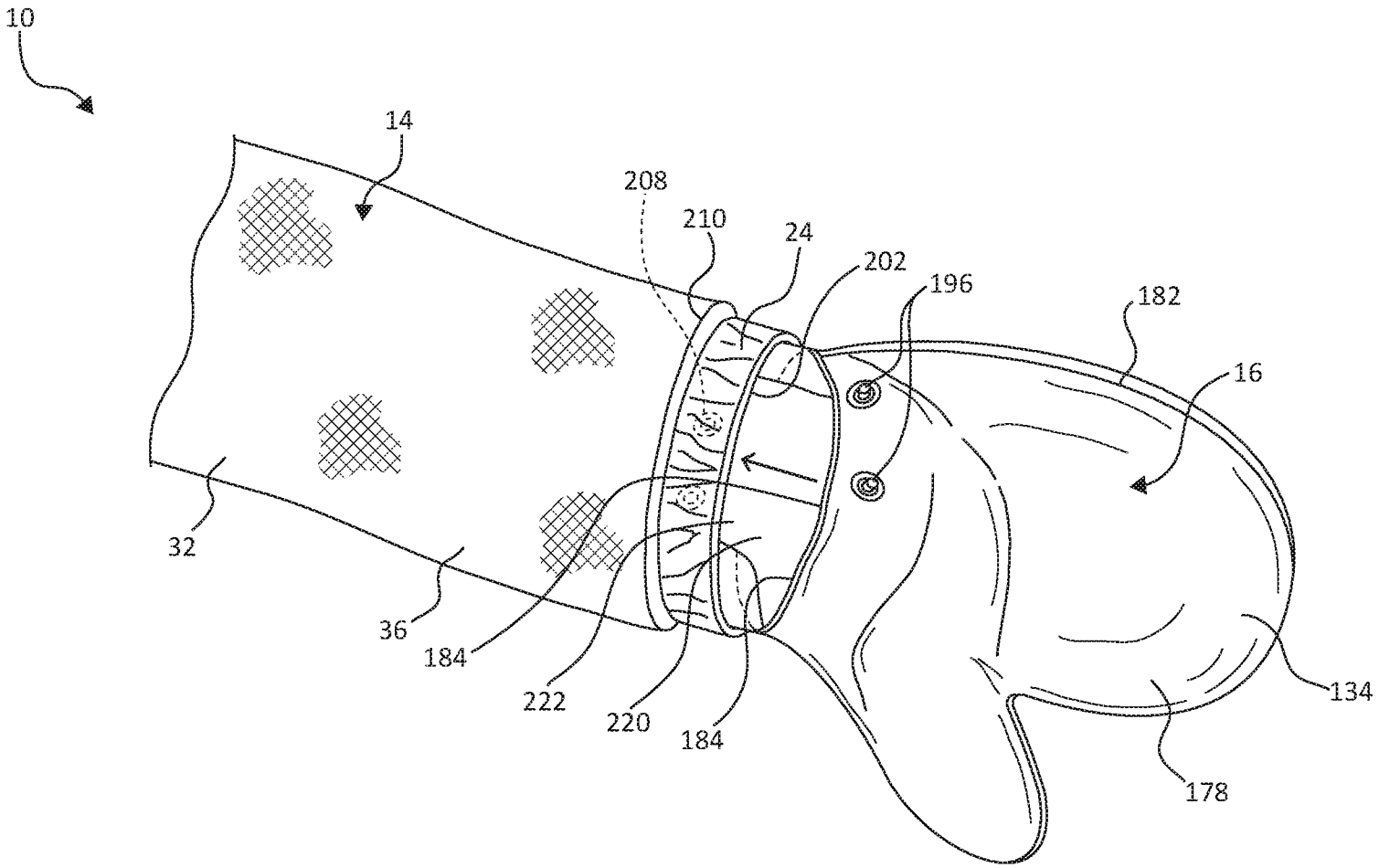
FIG. 11 is rear, perspective view of a portion of the sleeve turned right-side-out with the hand covering in the use position and the wearer's hand extending through the sleeve and into the hand covering, according to one embodiment of the present invention.

First side edge 76 and second side edge 78 of primary panel member 72 are then sewn together via elongated seam line 144 such that any seam allowances will face an exterior, that is, be opposite interior channel 34 or on the same side of primary liner member 70 as pocket panel 60. In one embodiment, interior liner 30 is fit within the tubular outer shell 32 of sleeve 14. In one example, sleeve 14 includes cuff 24 to finish off an end thereof that will be worn adjacent to wearer's hand 122 (FIGS. 10 and 11). In other embodiments, cuff 24 is eliminated.

Cuff 24 is formed of a suitable fabric, for example, similar to outer shell 32 sewn in a circular manner and folded about fold edge 202 to form two layers 198 and 199 each having a free edge 200 opposite fold edge 202 that are aligned with each other. In one example, a length of elastic 204 is positioned in cuff 24 adjacent fold edge 202 and between the two layers 198 and 199 of cuff 24. One or more suitable coupling members, such as a male or female side of a snap indicated as snap member 208, one side of a hook-and-loop fastener, or other suitable coupling member, is secured to cuff 24, e.g., to face rearwardly. In one example, snap members 208 are otherwise secured to outer shell 32 and/or interior liner 30 without cuff 24 or spaced from cuff 24, as will be apparent to those of skill in the art upon reading the currently application.

Figure 5:
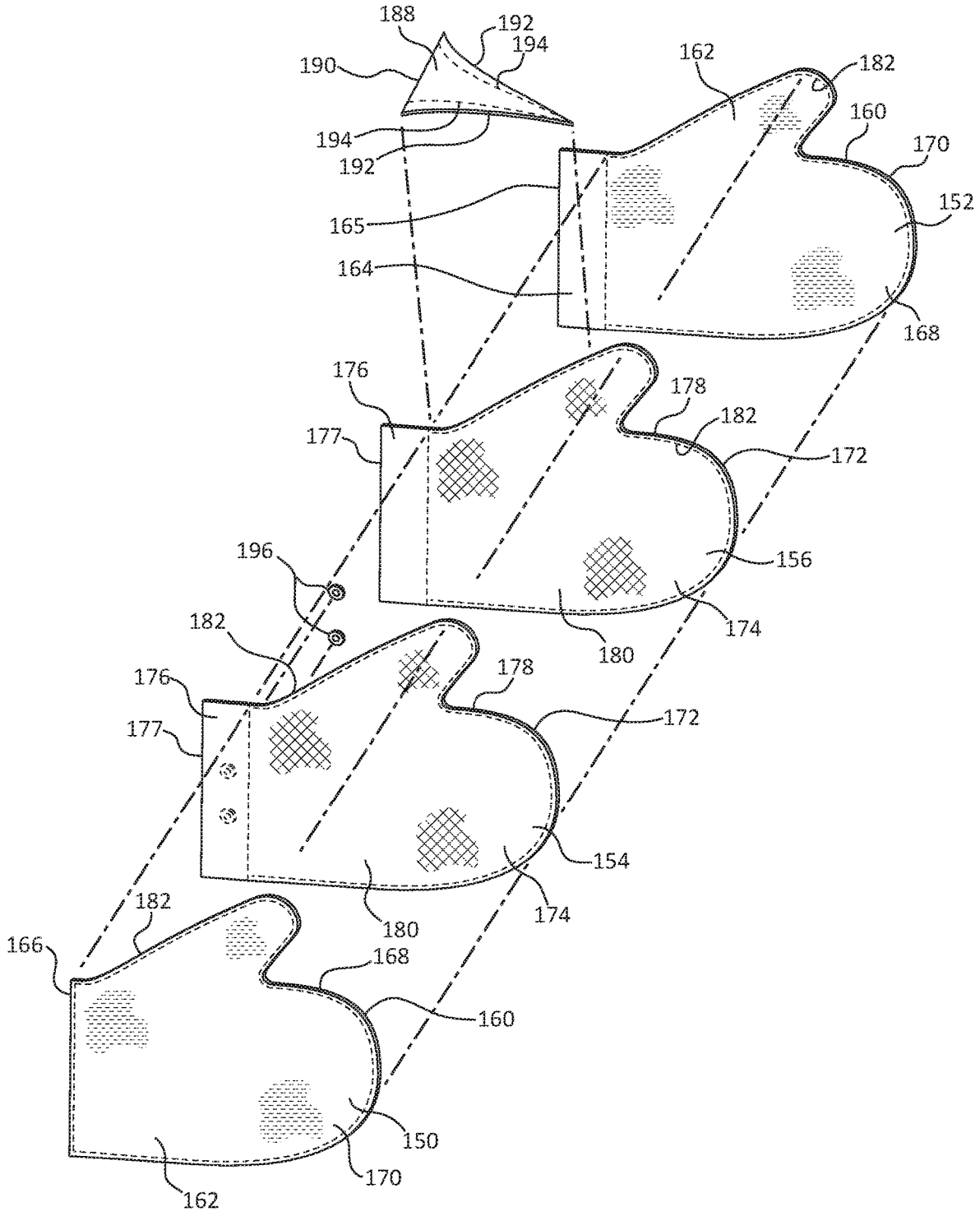
FIG. 5 is an exploded perspective view illustration of a hand covering, according to one embodiment of the present invention.
Figure 6:
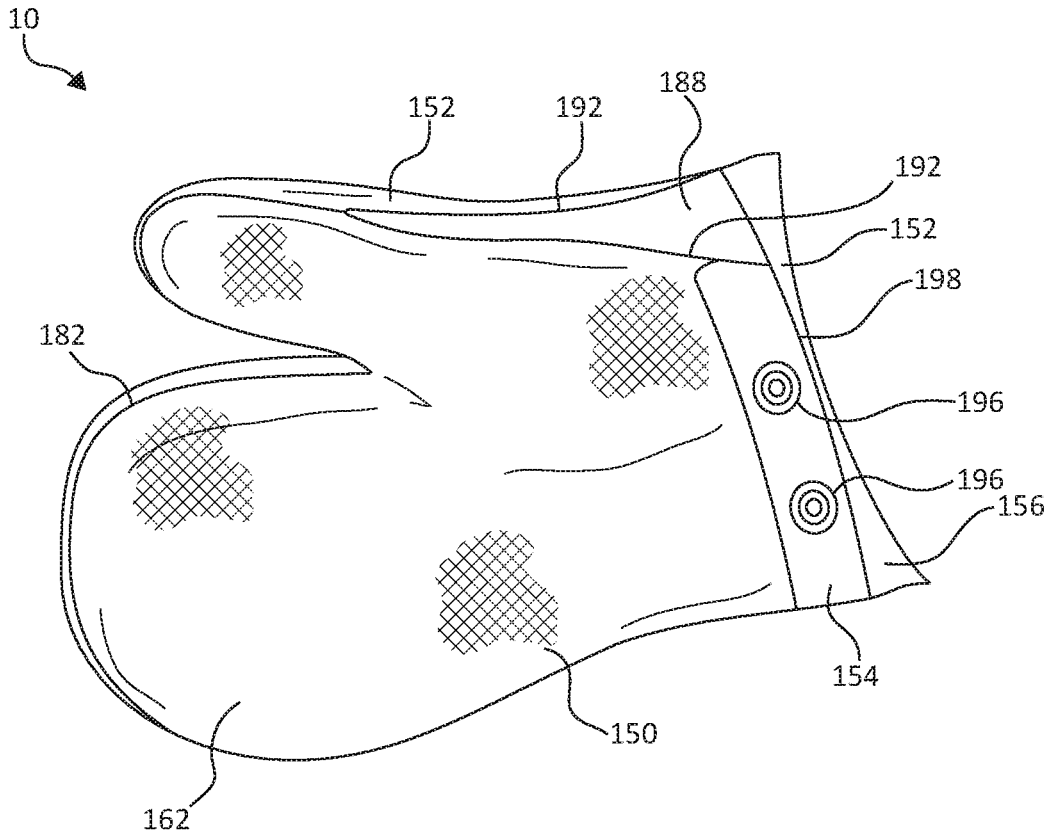
FIG. 6 is a perspective view illustration of the hand covering of FIG. 5, according to one embodiment of the present invention.

Hand covering 16 may be any suitable hand covering, most commonly, a glove, a mitten, a thumbless mitten, etc. While primarily described as a mitten herein, hand covering 16 is any assembly configured to selectively cover a wearer's hand 220 (see FIG. 10) to shield it, at least partially, from the elements. In one example, hand covering 16 is formed of two layers, an exterior layer being formed of a material similar to outer shell 32 and an interior layer being formed of a liner or soft material to be adjacent the wearer's hand 220. While primarily described herein as including multiple layers, in another embodiment, hand covering 16 is formed of a single layer any suitable fabric, such as a fabric substantially identical to the fabric forming outer shell 12, a knit fabric, a woven fabric, a non-woven fabric, etc. and such fabric may or may not provide warmth, resist water, block wind, etc. In the example having multiple layers, as illustrated in the exploded view of FIG. 5 and the assembled view of FIG. 6, in one embodiment, hand covering 16 includes a first interior member 150 and a second interior member 152 collectively forming the first layer and a first exterior member 154 and a second exterior member 156 collectively forming the second layer. Notably, in FIG. 5, first interior member 150, second interior member 152, first exterior member 154, and second exterior member 156 are arranged for assembly in an inside-out manner, not in as they appear in finished hand covering 16.

First interior member 150 and second interior member 152 are similarly formed except where specifically enumerated below. Both first interior member 150 and second interior member are formed of a similar fabric, such as suitable liner fabric or a fleece fabric, designed to feel comfortable on a wearer's hand 220 and, in one example, to add warmth to hand covering 16. In one embodiment, fabric forming first interior member 150 and second interior member 152 is relatively thin so as to avoid adding significant bulk to sleeve 14 when in the storage position. In another embodiment, first interior member 150 and second interior member 152 may add noticeable bulk to sleeve 14. Each of first interior member 150 and second interior member 152 define an exterior-facing surface 168 and an interior-facing surface 170 opposite exterior-facing surface 168. Each of first interior member 150 and second interior member 152 define a perimeter edge 160 defining hand covering or mitten portion 162, for example with a primary area for receiving the fingers of a wearer and a thumb area for receiving a wearer's thumb. First interior member 150 terminates at a bottom wrist edge 166. In one embodiment, second interior member 152, unlike first interior member 150 terminates in a coupling flange 164 extending further away from mitten portion 162 to a free wrist edge 165 spaced further away from an opposite end of mitten portion 162 than bottom wrist edge 166 is spaced from its corresponding opposite end of mitten portion 162.

First exterior member 154 and second exterior member 156 are similarly formed except where specifically enumerated below. Both first exterior member 154 and second exterior member 156 are formed of a similar fabric, such as a fabric configured to block wind or other elements such as a fabric suitable for use in forming outer shell 32. Each of first exterior member 154 and second exterior member 156 define an exterior-facing surface 180 and an interior-facing surface 178. Each of first exterior member 154 and second exterior member 156 define a perimeter edge 172 defining hand covering or mitten area 174, for example with a primary portion for receiving the fingers of a wearer and a thumb area for receiving a wearer's thumb, and, in one example, sized and shaped substantially similarly to mitten portion 162. First exterior member 154 and second exterior member 156 terminate in a coupling flange 176 extending further away from mitten portion 174 to a free wrist edge 177.

For assembly of hand covering 16, in one embodiment, exterior-facing surfaces 180 of first exterior member 154 and second exterior member 156 are placed to face each other aligning perimeter edges 172 of each with the other. An exterior-facing surface 168 of each of first interior member 150 and second exterior member 156 are placed adjacent an interior-facing surface 178 of a different one of first exterior member 154 and second exterior member 156. First interior member 150, second interior member 152, first exterior member 154, and second exterior member 156 are sewn to each other along a perimeter seam line 182. Notably, the particulars of seam line 182 and construction of hand covering 16 will be apparent to those of skill in the art upon reading this application. Variations are contemplated and included in the scope of this disclosure. For example, in one embodiment, first interior member 150 is first sewn to first exterior member 154 to collectively define a first side of hand covering 16 and second interior member 152 is separately sewn to second interior member 156 to collectively define a second side of hand covering 16, seam allowances are pressed away from the corresponding seam lines and then the two combinations are sewn together along seam line 182, such that all seam allowances are hidden between first and second interior members 150 and 152 and first and second exterior members 154 and 156 upon assembly of hand covering 16.

In one example, hand covering 16 additionally includes an elastic insert 188 formed in a substantially wedge shape defining a free wrist edge 190 and opposing side edges 192 tapering toward each other as they extend away from free wrist edge 190. Elastic insert 188 is sewn between the combination of first interior member 150 and first exterior member 154 and the combination of second interior member 152 and second exterior member 156 via a seam 194 along a thumb area of each. Elastic insert 188 selectively stretches to allow hand covering 16 to more easily receive a wearer's hand 122 (FIGS. 10 and 11) and biases back to be held more tightly to the wearer's hand 122.

In one embodiment, coupling flange 176 of first exterior member 154 is folded inwardly to cover a portion of interior-facing surface 170 adjacent wrist edge 166 to form a thicker portion of hand covering 16 and an open edge 184 of hand covering 16. In one example, one or more coupling members, such as male or female portions of a snap member 196 are coupled to coupling flange 176 and first exterior member 154 to face away from exterior-facing surface 180 of first exterior member 154. Coupling flange 164 of second interior member 152 and coupling flange 176 of second exterior member 156 are left extending away from a remainder of hand covering 16 for use in attaching hand covering 16 to sleeve 14, as will be further described below.

In one example, interior liner 30, outer shell 32, cuff 24 and hand covering 16 are all sewn together along a shared cuff seam 210 or a series of seam lines in any suitable method. For example, for assembly, outer shell 32 is turned right-side-out with exterior surface 36 facing outwardly, and cuff 24, is placed around outer shell 32 such that open edge 40 of outer shell 32 is aligned with free edges 200 of cuff 24 and a remainder of cuff 24 extends toward shoulder end 20 of outer shell 32 around and adjacent interior surface 38 of outer shell 32.

Hand covering 16 is turned right-side-out, that is, with first interior member 150 and second interior member 152 on the inside of hand covering 16, and laid on top of cuff 24 opposite a portion of outer shell 32. More specifically, in one example, hand covering 16 is placed so co-extensive wrist edges 165 and 177 of coupling flanges 164 and 176 of first interior member 150 and first exterior member 154 are aligned with a portion of open edge 40 of outer shell 32 and free edges 200 of cuff 24, such as, in one embodiment, to extend over a portion of cuff 24 opposite snap members 208 and so second exterior member 156 faces away from outer shell 32. Hand covering 16 extends from wrist edges 165 and 177 toward shoulder end 20 (see FIGS. 1 and 2). Interior liner 30 is placed around all of open edge 40, free edges 200, and wrist edges 165 and 177 so opening edge 46 and opening edge 134 collectively align with and interior liner 30 extends away from each of open edge 40, opening edge 46, free edges 200, and wrist edges 165 and 177 over and in the same direction as outer shell 32. Cuff seam 210 is sewn through each of outer shell 32, cuff 24, coupling flanges 164 and 176, and interior liner 30 relatively near open edge 40, opening edge 46, free edges 200, and wrist edges 165 and 177. In one embodiment, part of cuff seam 210 is sewn through primary liner member 70 of interior liner 30 and part of cuff seam 210 extends through exterior pocket panel member 74.

Once cuff seam 210 is formed, interior liner 30, which extends around outer shell 32 while cuff seam 210 is formed, is pulled to extend from cuff seam 210 in an opposite direction as outer shell 32 and then is pushed into the interior of outer shell 32 such that exterior facing surface 84 of primary liner member 70 faces interior surface 38 of outer shell 32 and interior liner 30 extends from cuff 24 to shoulder end 20. In this manner, any seam allowances of outer shell 32, interior liner 30, hand covering 16, and cuff 24 adjacent cuff seam 210 are enclosed and hidden from view between interior liner 30 and outer shell 32 creating a very clean appearance. Once sleeve 14 is so formed, it is coupled with torso covering portion 12 in any suitable manner.

Figure 7A:
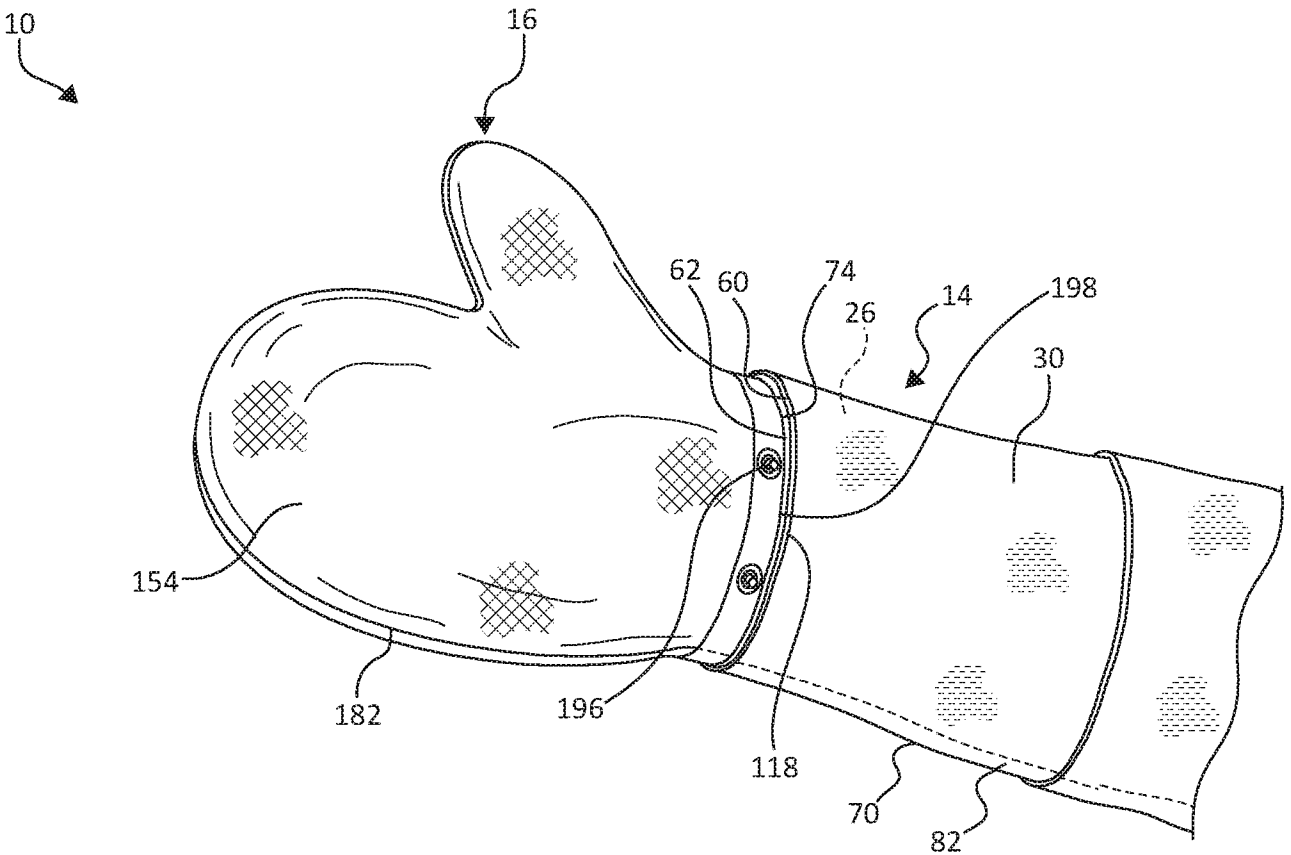
FIG. 7A is a front, perspective view illustration of a portion of the sleeve and hand covering with the sleeve turned inside-out and the hand covering in the extended position, according to one embodiment of the present invention.
Figure 7B:
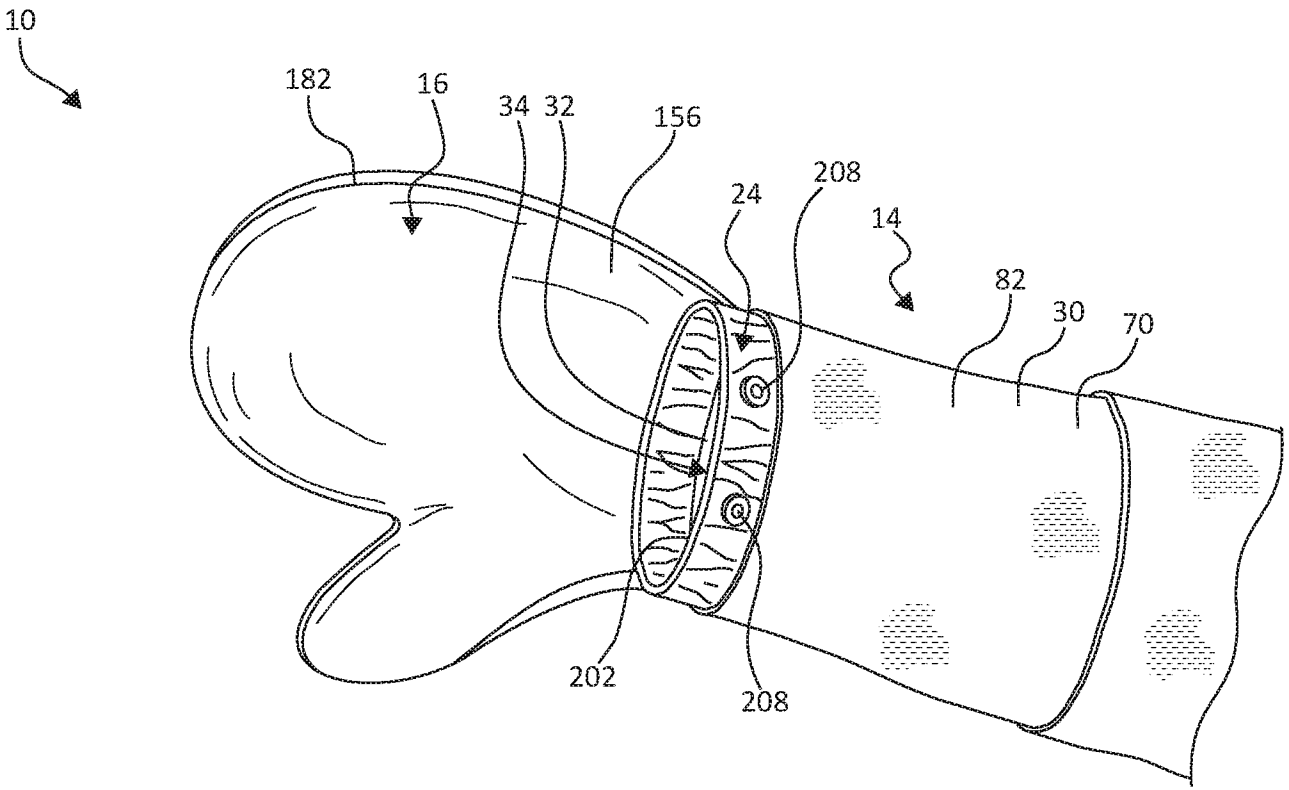
FIG. 7B is a front, perspective view illustration of a portion of the sleeve and hand covering with the sleeve turned inside-out and the hand covering in the extended position, according to one embodiment of the present invention.
Figure 8A:
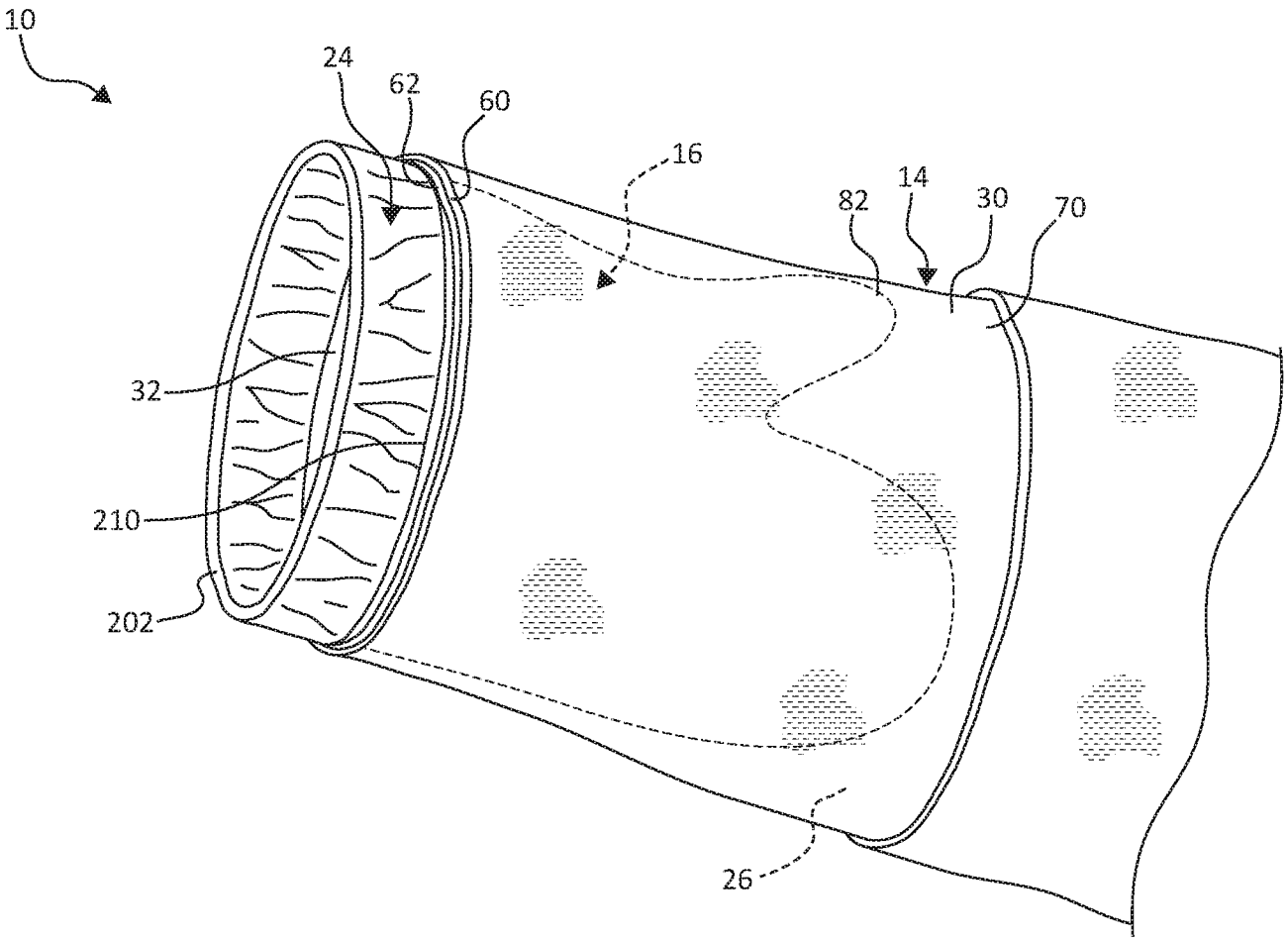
FIG. 8A is a rear, perspective view illustration of a portion of the sleeve and hand covering with the sleeve turned inside-out and the hand covering in the storage position, according to one embodiment of the present invention.
Figure 8B:
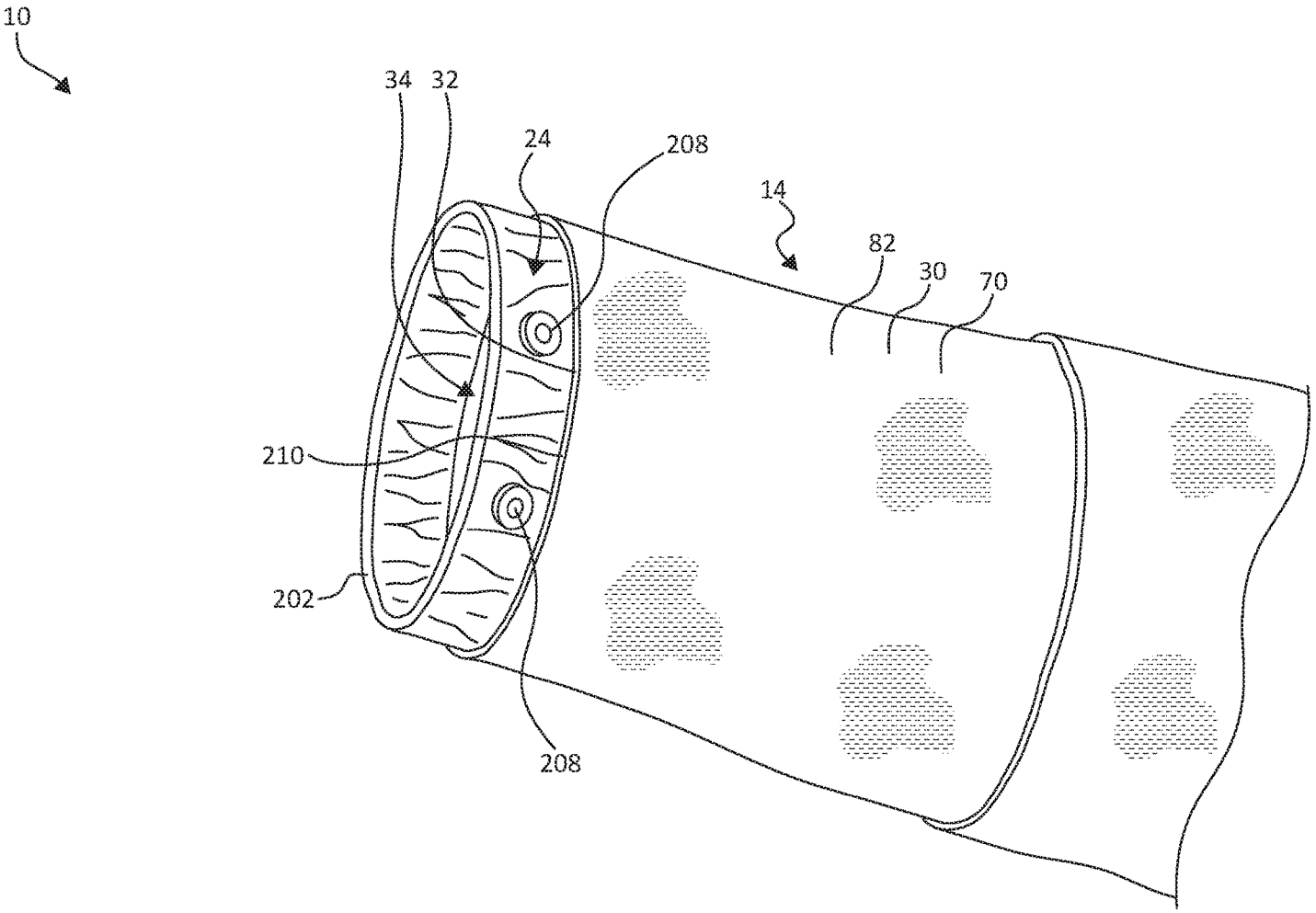
FIG. 8B is a front, perspective view illustration of a portion of the sleeve and hand covering with the sleeve turned inside-out and the hand covering in the storage position, according to one embodiment of the present invention.
Figure 9A:
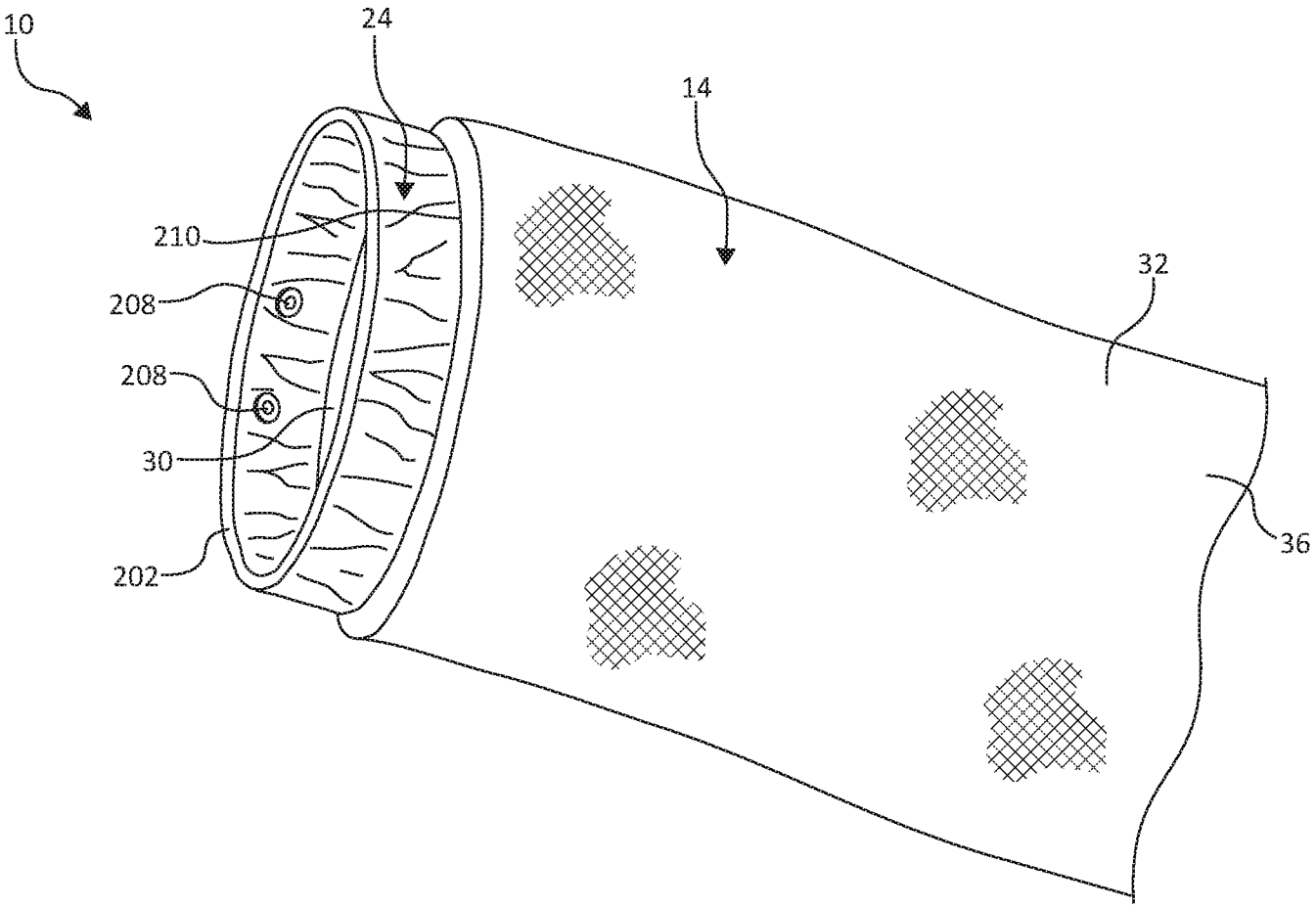
FIG. 9A is a front, perspective view of a portion of the sleeve turned right-side-out with the hand covering in the storage position, according to one embodiment of the present invention.
Figure 9B:
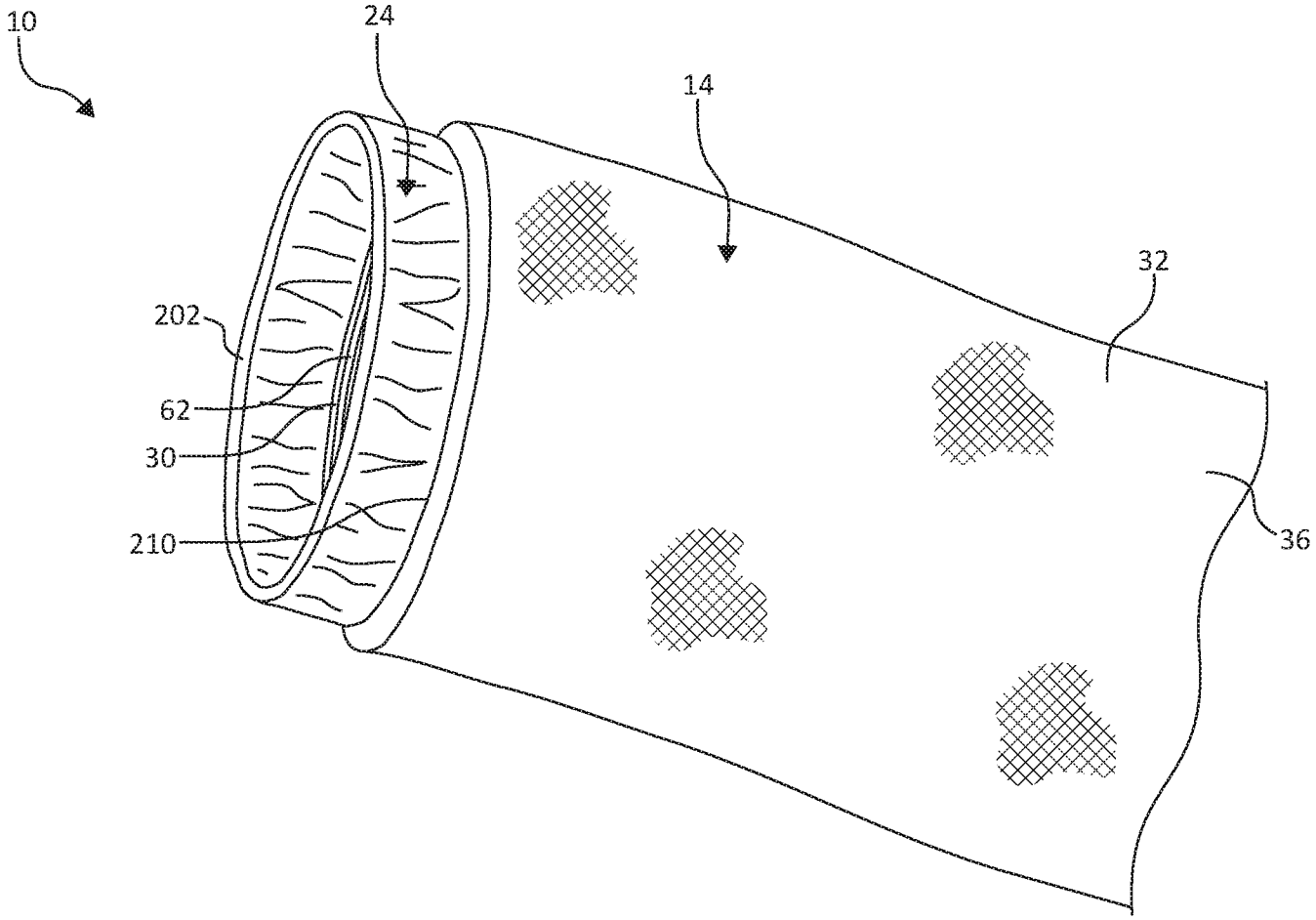
FIG. 9B is a rear, perspective view of a portion of the sleeve turned right-side-out with the hand covering in the storage position, according to one embodiment of the present invention.
Figure 12:
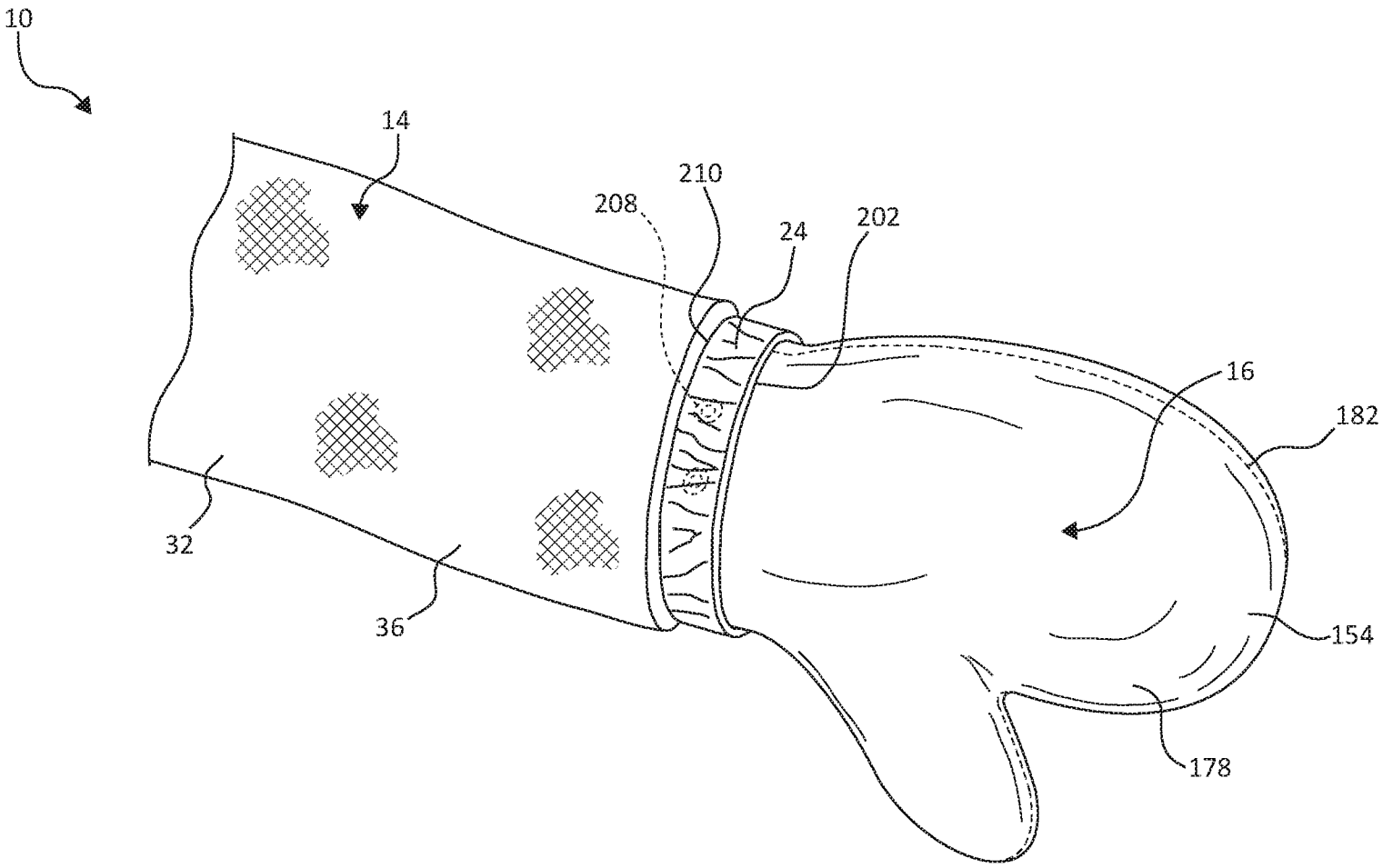
FIG. 12 is rear, perspective view of a portion of the sleeve turned right-side-out with the hand covering in the use position with the hand covering selectively secured in the use position covering the wearer's hand, according to one embodiment of the present invention.

FIGS. 7A and 7B illustrate a lower portion of assembled sleeve 14 inside-out and with hand covering 16 in an extended or use position, FIGS. 8A and 8B illustrate a lower portion of assembled sleeve 14 inside-out with hand covering 16 in a storage position, FIGS. 9A and 9B illustrate a lower portion of assembled sleeve 14 right-side-out with hand covering 16 in an storage position, and FIGS. 10-12 illustrate a lower portion of assembled sleeve 14 inside-out and with hand covering 16 in an extended or use position all resulting from construction substantially similar to that described above.

FIGS. 7A and 7B, more specifically, show different sides of the sleeve 14 with hand covering 16 in the same position. As illustrated, in FIG. 7A the above-described construction results in a very neat presentation of interior pocket 26, open toward cuff 24 (see FIG. 7B) that is not readily perceivable without closer inspection. As illustrated in FIG. 7B, the opposing sides of cuff 24 remain similar to typical coat 10 construction other than snap members 208. Since interior pocket 26 is formed of a relatively thin material, in one example, interior pocket 26 adds very little bulk to sleeve 14 as compared to other portions of sleeves 14 with no such pocket.

Referring to FIG. 8A, even when hand covering 16 is placed in interior pocket 26 pocket opening 62 lies relatively flat with little bulk added to the interior of sleeve 14 and with little disruption to interior liner 30. The lack of bulk is the result of using thin materials for hand covering 16 as, in one embodiment, hand covering 16 is made for temporary relief from the elements and is not intended for long wear in extreme cold or snow. In one embodiment, hand covering 16 is formed of thicker materials to provide more protection from extreme cold and snow. As illustrated in FIG. 8B, the opposing sides of cuff 24 remain similar to typical coat 10 construction other than snap members 208 even when hand covering 16 is in the storage position. FIGS. 9A and 9B further illustrate the hidden nature of hand covering 16 while in the storage position as viewed when coat 10 is in its right-side out orientation.

FIGS. 10-12 illustrate a portion of sleeve 14 when coat 10 is in use and hand covering 16 is extended. As shown in FIG. 10, when hand covering 16 is initially extended, a wearers wrist 222 and a wearer's hand 220 extend from inside sleeve 14 out cuff 24 in a manner adjacent to extended hand covering 16. Referring now to FIG. 11, open edge 184 of hand covering 16 opposite the portion of hand covering 16 sewn into sleeve 14, is pulled forwardly and to the side to receive and slide over wearer's hand 220. Finally, as shown in FIG. 12, snap members 196 of hand covering 16 are mated with snap members 208 of sleeve 14 to secure hand covering in a manner fully enclosing the wearer's hand 220 and the wearer's wrist 222 therein.

An outerwear article as described above, provides a selectively hidden hand covering that is selectively stored in a pocket formed between the interior liner and the outer shell of the outerwear article. The pocket is open along and near to the sleeve opening. In one example, one side of the hand covering is sewn along a seam adjacent sleeve opening and the adjacent the pocket opening. Hand covering rotates about the seam line to extend directly into the pocket for storage within or to extend out of the sleeve opening for use. In one example, hand covering provides some protection from the elements, but adds very little overall bulk to each sleeve. In one example, when hand covering is extended from the sleeve opening and pulled over the hand of the user, a side of the hand covering opposite the coupling seam line is selectively coupled to the sleeve via snaps, hook-and-loop fastener, or other suitable coupling member. As such, outerwear article provides for a hand covering selectively extendable from its sleeve with self-storage inside the sleeve, between the outer shell and the liner during periods of non-use.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. An outerwear article comprising:

a sleeve extending from a shoulder end to an open end, the sleeve including a liner, an outer shell extending around the liner, and a pocket defined between the outer shell and the liner, wherein the pocket has an opening on an inside of the sleeve and on a side of the pocket nearest the open end;

a hand covering sewn to the sleeve adjacent the opening via a seam line, the hand covering being rotatable about the seam line from a storage position within the pocket to a use position extending from the seam line out the open end of the sleeve to fit over a wearer's hand; and a cuff formed separately from the sleeve and the hand covering, the cuff being circumferentially secured to the sleeve to extend about the open end of the sleeve, wherein:

the seam line is positioned adjacent the cuff, and the cuff extends from the seam line away from the sleeve.

2. The outerwear article of claim 1, wherein the pocket is on a front side of the sleeve.

3. The outerwear article of claim 1, wherein the cuff is sewn to the outer shell to be circumferentially secured to the sleeve via the seam line.

4. The outerwear article of claim 3, wherein the cuff is sewn to the liner via the seam line.

5. The outerwear article of claim 1, wherein:

the hand covering includes a coupling flange sewn to the sleeve to extend between the pocket and the outer shell in a manner maintaining the coupling flange outside of the pocket.

6. The outerwear article of claim 5, wherein:

the outerwear article includes a first coupling member secured to the outerwear article adjacent the open end and opposite the coupling flange of the hand covering, the hand covering includes a second coupling member opposite the coupling flange, and the first coupling member is selectively securable to the second coupling member to selectively secure the hand coving to the side of the sleeve opposite the coupling flange.

7. The outerwear article of claim 1, wherein the hand covering includes an exterior layer and an interior layer.

8. The outerwear article of claim 7, wherein the exterior layer is formed of a substantially identical material as the outer shell.

9. The outerwear article of claim 1, wherein the hand covering includes a front side, a rear side, and an elastic insert extending between the front side and the rear side adjacent the opening of the hand covering.

10. The outerwear article of claim 9, wherein the front side is sewn to the sleeve via the seam line, and the rear side is selectively securable to the sleeve.

11. The outerwear article of claim 1, wherein the opening is a welt opening.

12. The outerwear article of claim 1, wherein the hand covering is sewn to the sleeve adjacent the opening and the open end of the sleeve via the seam line.

13. An outerwear article comprising:

a sleeve extending from a shoulder end to an open end, the sleeve including a liner, an outer shell extending around the liner, and a pocket defined between the outer shell and the liner, wherein the pocket has an opening on an inside of the sleeve and on a side of the pocket nearest the open end; and a hand covering sewn to the sleeve adjacent the opening via a seam line, the hand covering being rotatable about the seam line from a storage position within the pocket to a use position extending from the seam line out the open end of the sleeve to fit over a wearer's hand;

wherein:

the liner includes a primary liner member, an interior pocket panel member, and an exterior pocket panel member, the interior pocket panel member is sewn to the exterior pocket panel member along at least a portion of outer perimeters thereof to form the pocket between the interior pocket panel member and the exterior pocket panel member, and the pocket is positioned between the primary liner member and the outer shell.

14. The outerwear article of claim 13, further comprising a cuff formed as a separate piece of the outwear article than the sleeve, extending about the open end of the sleeve, wherein the cuff is coupled to the outer shell via sewing forming the seam line, the seam line is positioned adjacent the cuff, and the seam line extends through the primary liner member to couple the liner with the outer shell.

15. The outerwear article of claim 13, wherein the interior pocket panel member and the exterior pocket panel member are sewn to each other along an edge of the pocket opposite the opening of the pocket.

16. A garment sleeve comprising:

a liner including:

a primary liner member extending from a shoulder end of the garment sleeve to an open end of the garment sleeve, and an interior pocket panel member coupled to the primary liner adjacent the open end of the garment sleeve such that a pocket is formed between the interior pocket panel member and the primary liner, the pocket being open on a side of the pocket nearest the open end of the garment sleeve; and an outer shell extending around the liner and extending from the shoulder end to the open end, and a hand covering coupled to the outer shell via a seam line on a first side of the hand covering such that the hand covering is rotatable about the seam line between a storage position within the pocket and a use position extending out the open end of the garment sleeve.

17. The garment sleeve of claim 16, further comprising:

a cuff, formed separately from the liner and the outer shell, extending about the open end of the sleeve, wherein:

the cuff is sewn and coupled to the outer shell via the seam line, and the seam line is positioned adjacent the cuff.

18. The garment sleeve of claim 16, wherein the seam line is formed adjacent the open end of the garment sleeve, and the pocket is open on an end nearest the open end of the garment sleeve.

19. The garment sleeve of claim 16, further comprising:

a first coupling member coupled to the outer shell opposite the coupling of the hand covering to the outer shell via the seam line, a second coupling member coupled to the hand covering opposite the coupling of the hand covering to the outer shell via the seam line, and wherein the first coupling member and the second coupling member are selectively couplable with one another to further secure the hand covering to a remainder of the garment sleeve.

20. The garment sleeve of claim 19, wherein:

the hand covering includes a coupling flange sewn to the sleeve to extend between the pocket and the outer shell, and the coupling flange is positioned opposite the second coupling member.

* * * * *